US007450081B1

(12) United States Patent
Punnoose

(10) Patent No.: US 7,450,081 B1
(45) Date of Patent: Nov. 11, 2008

(54) COMPACT LOW FREQUENCY RADIO ANTENNA

(75) Inventor: Ratish J. Punnoose, Hayward, CA (US)

(73) Assignee: Sandia Corporation, Livermore, CA (US)

( * ) Notice: Subject to any disclaimer, the term of this patent is extended or adjusted under 35 U.S.C. 154(b) by 85 days.

(21) Appl. No.: 11/717,295

(22) Filed: Mar. 12, 2007

(51) Int. Cl.
*H01Q 21/26* (2006.01)

(52) U.S. Cl. ..... 343/797; 343/802

(58) Field of Classification Search ..... 343/797, 343/795, 802, 752
See application file for complete search history.

(56) References Cited

U.S. PATENT DOCUMENTS

| | | | | |
|---|---|---|---|---|
| 3,811,127 | A | 5/1974 | Griffee et al. | 343/705 |
| 3,987,458 | A | 10/1976 | Reggia et al. | 343/846 |
| 4,595,928 | A | 6/1986 | Wingard | 343/742 |
| 4,878,062 | A * | 10/1989 | Craven et al. | 343/872 |
| 5,173,715 | A | 12/1992 | Rodal et al. | 343/795 |
| 5,521,610 | A * | 5/1996 | Rodal | 343/797 |
| 5,592,182 | A * | 1/1997 | Yao et al. | 343/742 |
| 5,767,813 | A | 6/1998 | Verma et al. | 343/744 |
| 6,741,212 | B2 | 5/2004 | Kralovec et al. | 343/700 MS |
| 6,856,292 | B2 | 2/2005 | Kuramoto et al. | 343/702 |
| 6,888,510 | B2 | 5/2005 | Jo et al. | 343/797 |
| 6,888,511 | B2 | 5/2005 | Cake | 343/803 |
| 6,999,032 | B2 | 2/2006 | Pakray et al. | 343/713 |

OTHER PUBLICATIONS

Rashed, J.; Tai, C-T.; "Anew Class of Resonant Antennas," *IEEE Transactions on Antennas and Propagation, Communications*, 1991, v.39(9): pp. 1428-1430.

Legg, G.; "Embedded Antennas get the signal," EDN Magazine, Aug. 8, 2002, (http://www.edn.com/toc-archive/2002/20020808.html), *techtrends*: pp. 67.

* cited by examiner

*Primary Examiner*—Hoang V Nguyen
(74) *Attorney, Agent, or Firm*—Timothy P. Evans

(57) ABSTRACT

An antenna is disclosed that comprises a pair of conductive, orthogonal arches and a pair of conductive annular sector plates, wherein adjacent legs of each arch are fastened to one of the annular sector plates and the opposite adjacent pair of legs is fastened to the remaining annular sector plate. The entire antenna structure is spaced apart from a conductive ground plane by a thin dielectric medium. The antenna is driven by a feed conduit passing through the conductive ground plane and dielectric medium and attached to one of the annular sector plates, wherein the two orthogonal arched act as a pair of crossed dipole elements. This arrangement of elements provides a radiation pattern that is largely omni-directional above the horizon.

25 Claims, 11 Drawing Sheets

COMPACT LOW FREQUENCY RADIO ANTENNA

STATEMENT OF GOVERNMENT SUPPORT

The United States Government has a paid-up license in this invention and the right in limited circumstances to require the patent owner to license others on reasonable terms as provided for by the terms of contract No. DE-AC04-94AL85000 awarded by the U.S. Department of Energy to Sandia Corporation.

CROSS REFERENCE TO RELATED APPLICATIONS

None

BACKGROUND OF THE INVENTION

1. Field of the Invention

The present invention generally relates to a radio antenna. More particularly, the present invention relates to an improved radio antenna that is compact, mountable to a conductive surface, and having nearly constant gain over a hemisphere of solid angle so that it is essentially omni-directional when located near the surface of the earth.

2. Related Art

It is generally known that antenna performance is dependent upon the size and shape of the constituent antenna elements as well as the relationship between various antenna physical parameters (e.g., the length for a linear antenna and diameter for a loop antenna) and the wavelength of the signal. These relationships determine several antenna operational parameters, including input impedance, gain, and radiation pattern. In general, the minimum physical dimension for an operable antenna is on the order of a quarter wavelength of the operating frequency or some multiple thereof.

The rapid and wide spread growth and utilization of GPS and wireless communications and the evolution of the devices that support these systems has created a continued need for physically smaller, more efficient antennae that are capable of wide bandwidth operation, and multiple frequency-band operation. As the size of these devices shrink, the antennae used by the devices must shrink correspondingly. Thus physically small antennae operating in the frequency bands of interest and providing properties such as high gain and omni-directionality continue to be sought after.

One antenna commonly used in many applications today is the half-wavelength dipole antenna. The radiation pattern of this device is the familiar toroidal donut shape with most of the energy radiated uniformly in 360° of rotation perpendicular to the longitudinal axis of the dipole with energy decreasing with increasing angular elevation from the horizon. Antenna gain, therefore, is highest for a vertical dipole in a plane of the horizon and decreases with increasing angular elevation from the horizon. In order to efficiently detect systems such as GPS and cellular signals, it is desirable to have an antenna whose gain is nearly constant gain over a hemisphere of solid angle so that it is essentially omni-directional above the horizon for antennae located near the surface of the earth.

SUMMARY

It is therefore an object of this invention to provide an improved antenna having an essentially omni-directional above the antenna horizon.

Another object of the invention is to provide an improved antenna that is easily tunable with simple circuit elements such as capacitors.

Yet another object of the invention is to provide an antenna designed to use a metallic surface under it as a ground-plane.

A further object of the invention is to provide an antenna that can provide a circularly polarized signal.

To achieve these and other objects, there is provided an antenna structure having hemispherical orthogonally crossed elements that may be electrically fed together or separately. Moreover, these and other objects, advantages, and features of the invention will become apparent to those skilled in the art after reading the following description of the various embodiments when considered with the appended claims.

BRIEF DESCRIPTION OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE PREFERRED EMBODIMENTS

In the following disclosure and in the appended claims, terms such as "normal" and "right angles," are used which relate one structure to another or to the environment. These terms are intended to mean "generally," or "substantially" normal, etc., to allow for some reasonable degree of tolerance that does not preclude the substantial attainment of the objects and benefits of the invention, and are not intended to mean "exactly" 90°.

Figure 1A:
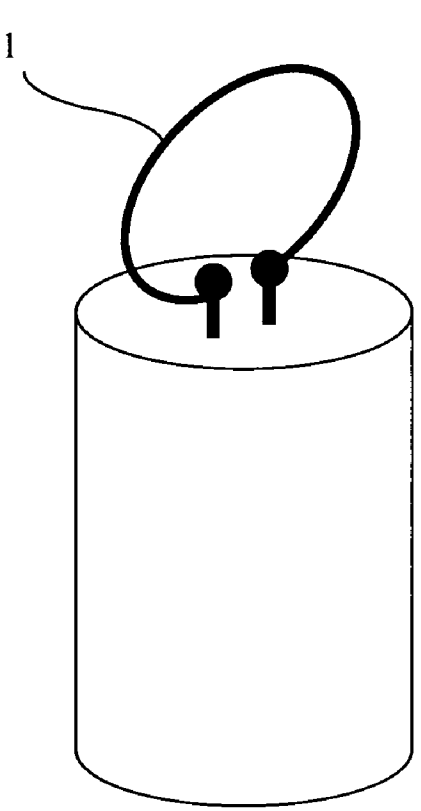
FIGS. 1A-1C show the derivation of the antenna according to the present embodiment from a loop antenna.
Figure 1B:
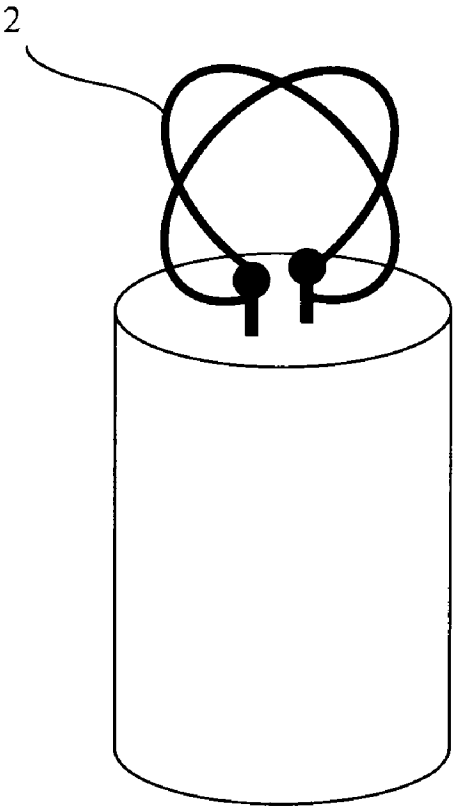
Figure 1C:
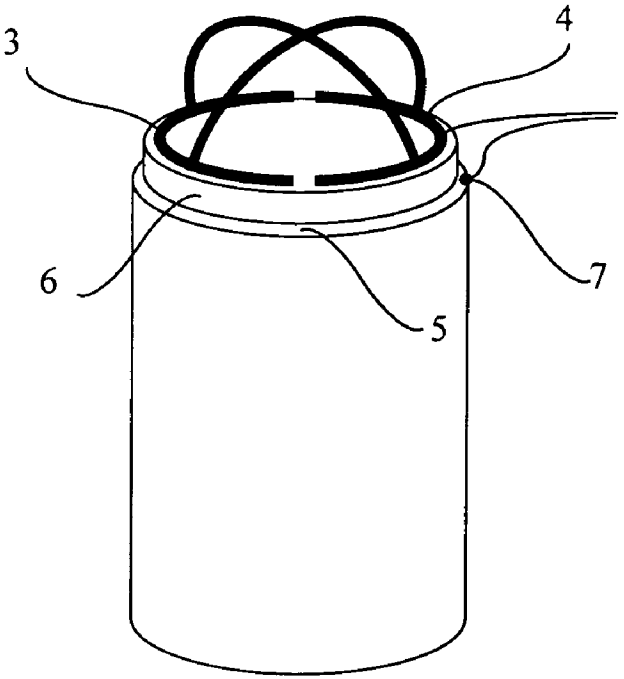

In general, the size of an antenna should be an integer fraction of the wavelength transmission/reception. However, in addition to changing its size, the resonant frequency of an antenna can be altered also by simple changes in its physical structure. The following design shows an antenna that can be small compared to the wavelength. The design being advanced is a derivative of a loop antenna. In general, FIGS. 1A-1C show the design progression as follows:

The starting point for the design is a conventional vertical loop antenna 1, such as in FIG. 1A;

A second vertical loop antenna 2 whose axis is perpendicular to the first loop 1 is added as shown in FIG. 1B;

The upper half of the combined structure, obtained by slicing midway with a horizontal plane, is attached to a circular ring that is split into two arcs 3 and 4, as shown in FIG. 1C;

The resultant cross-shaped dome-like structure is then placed above a ground plane 5 with an intervening dielectric layer 6 to prevent the structure from directly contacting the ground plane; and An electrical feed-point 7 to the antenna is placed between the ground plane and one of the horizontal arc segments.

Figure 2A:
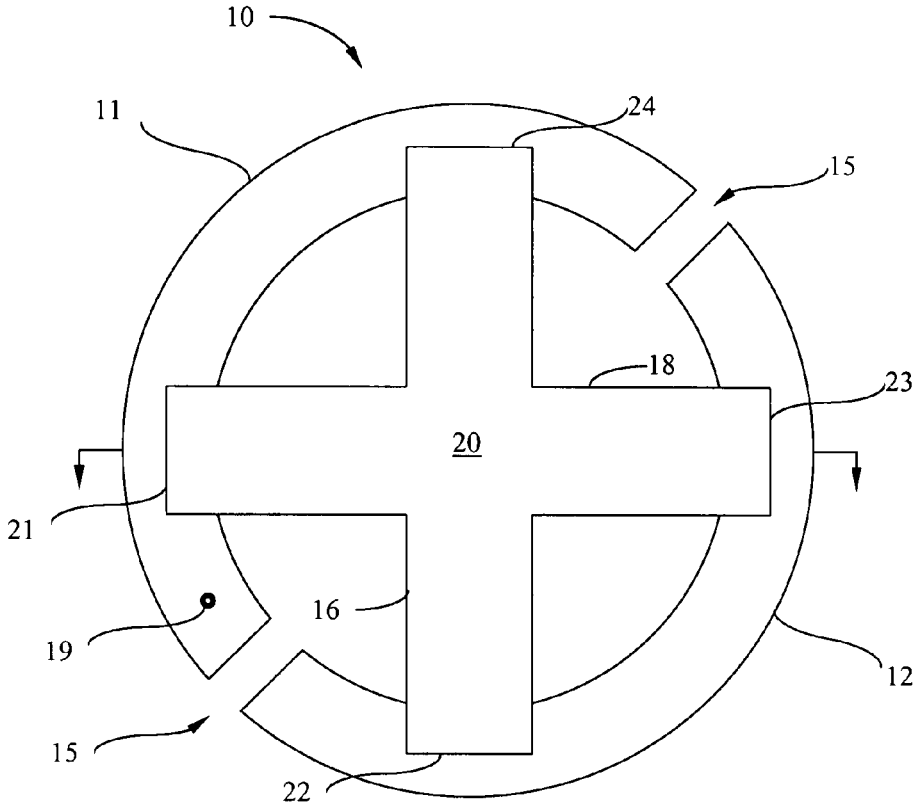
FIG. 2A is a top view of an antenna according to a hemispheric embodiment of the present invention showing the two gaps between the horizontal arcs.
Figure 2B:
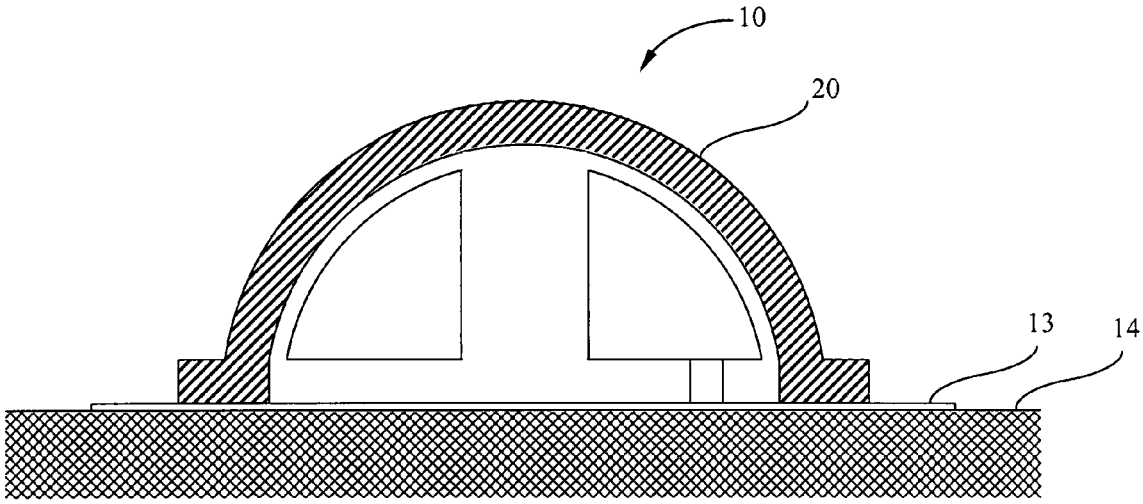
FIG. 2B is a cross-sectional side view of the antenna according to the embodiment shown in FIG. 2A, the relationship between the cross-like members and the semi-circular ring segments, and the dielectric layer and ground plane.

The antenna of one embodiment of the invention, therefore, is shown in FIGS. 2A and 2B and comprises a split horizontal annular plate combined with two semi-circular arch-like structures all of which are conductive and in electrical communication with one another such that when the arch-like structures are electrically driven with a radio frequency (RF) signal they function as crossed dipole radiator elements. However, while a hemispherical structure is shown in FIG. 2A, many other geometries are possible. These may include, but are not limited to, a hemi-ellipsoid or oblate hemisphere; a cube; an orthorhombic prism; and a polyhedral pyramidal structure, wherein the structures may comprise single straight segments, multiple-straight segments, single curving segments, or a combination of straight and curving segments. Moreover, the number of dipole radiators (i.e., a mirror-image pair of oppositely directed elements) may be any number greater than 2. Examples of these structures and various combinations thereof are shown in FIGS. 3A-3I and while not all may be practical they are shown for illustrative purposes as delineating the scope of the embodiments described herein.

The simplest of these embodiments is shown in FIGS. 2A and 2B and forms the basis for describing the present invention. However, other structures are possible such as those shown in FIGS. 3A and 3B.

The antenna, in accordance with the embodiment illustrated by FIGS. 2A and 2B, is described as follows. Antenna 10 comprises a pair of conductive plates, in this case semi-circular ring segments 11 and 12 cut from a flat plate each forming a portion of an annulus. Ring segments 11 and 12 rest on dielectric layer 13 above conductive ground plate 14 and are located opposite each other at a mirror-plane and on a common diameter such that opposite ends of each ring form a gap 15 of equal size at either side of the sector sections. In addition, antenna 10 further comprises an electrically conductive radiation structure 20, shown in FIG. 2B as a hemispherical dome having four adjacent and equally sized sector wedges cut through the thickness of the dome to form a cross-like structure comprising two wide, semicircular arches 16 and 18 crossing each other at right angles. Semicircular arches 16 and 18, therefore, comprise two pairs of oppositely directed radiator elements. Moreover, structure 20 is joined to ring segments 11 and 12 in such a way that the inside edge of each of the legs 21, 22, 23 and 24 of structure 20 are located along a common diameter between the inside and outside diameters of ring segments 11 and 12. In addition, legs adjacent one another across the gaps 15 are disposed about equidistant from each other.

Figure 4:
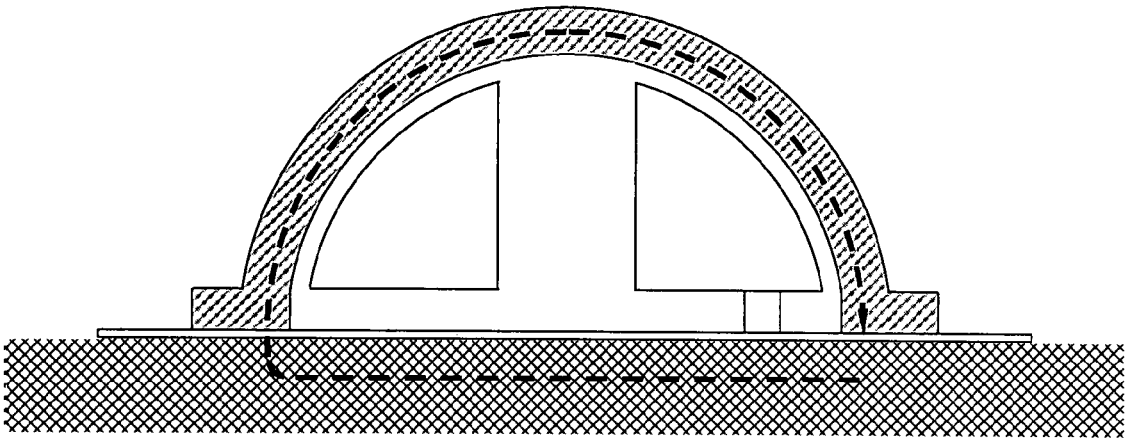
FIG. 4 is a cross-sectional view of the antenna according to the embodiment of FIG. 2A showing the electrical field during antenna operation.

In general, antenna 10 is electrically excited on one of the two ring segments 11 and 12 at feed point 19. The opposite side of the horizontal ring segments 11 and 12 are optionally connected using an electrical element such as a capacitor to provide additional tuning flexibility. Finally, antenna 10 is physically secured above the ground plane using a set of fasteners such as screws or bolts (not shown). However, care must be taken to ensure that the fasteners do not provide an electrical path between the ground plane and the antenna structure since the dielectric insulating layer is intended to act as a capacitor from the antenna to ground. That is, the fasteners must be either electrically insulating (e.g. nylon screws) or electrically isolated from the horizontal ring by using a heavy plastic bushing or insert sleeve, for instance, around each of the bolts or screws. Alternatively, the major parts of the antenna may be fastened to the dielectric and the dielectric to the ground plane by the use of an adhesive layer. FIG. 4 shows the circuit of the electric current as the antenna, according to the present embodiment, is driven with a radio frequency signal.

Figure 5:
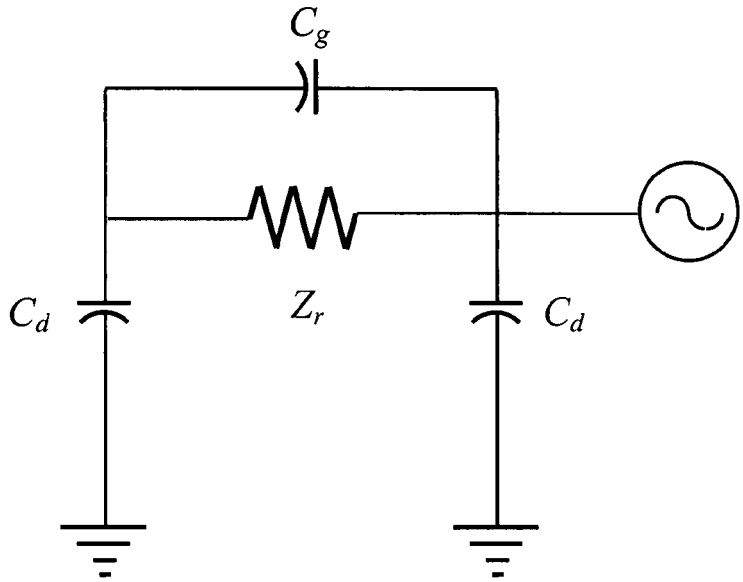
FIG. 5 shows an electrical circuit which models the electrical behavior of the antenna described herein.

The antenna has a narrow bandwidth and must be tuned to the desired frequency. As seen in the electrical model of the antenna shown in FIG. 5, the thickness of the dielectric insulating plate and the gaps between the horizontal annular plates substantially affect the capacitance of the antenna. $Z_r$ encapsulates the radiation resistance and inductance of the antenna. $C_d$ is the capacitance between each horizontal arc of the antenna structure and the ground plane. If extra capacitance is added between the "free" end of the horizontal ring and the ground plane, it will contribute to $C_d$. $C_g$ is the capacitance of the gap 15 between each of the two arcs.

Therefore, dielectric insulator 13 acts as a capacitor from the antenna to ground as do gaps 15 between the conductive plate segments shown in FIG. 2A. Both provide a means for adding capacitance from the primary "feed" arm of the antenna to the secondary arm and both of these features can be adjusted to tune the antenna for the desired frequency. In particular, the antenna frequency can be changed by i) altering the thickness of the dielectric insulator; ii) by changing the width of the gap between the horizontal arcs; iii) by adding additional capacitance between the "free" end of the horizontal ring and the ground plane; or iv) by changing a combination of these parameters. By adjusting these parameters, the antenna can be forcibly tuned to a frequency much smaller than the resonant frequency of a simple loop antenna of similar dimensions. Furthermore, this antenna is designed to use the metallic surface under it as a ground plane and is not negatively impacted by it.

The design described herein can be fabricated in many ways. The ground plane underneath the antenna must be conductive; and while this requirement may be met in many ways, a piece of metal sheet stock or a metal-coated surface will suffice. The dielectric layer above the ground plane can be made from any electrically insulating materials such as plastics, plastic resins, epoxy resins, mica, glass, and the like. In particular, acetal (e.g. DELRIN®) or polycarbonate (e.g. LEXAN®) resins, or filled, epoxy resins such as fiberglass are useful in this regard since they are relatively inexpensive, and can be purchased as sheet stock readily available in a variety of thicknesses. The dome structure of the embodiment of FIG. 2A can be made from any useful electric conductor but is best fabricated from a common metal or metal alloy such as aluminum, copper, or steel. Alternatively, the dome structure may be cast or molded from a polymer resin, a thermoplastic, or a thermosetting is plastic and then coated with a conducting layer either by electrical or electroless plating, vapor spraying, sputtering, particle vapor deposition, chemical vapor deposition. The thickness of the conductive coating affects antenna losses.

Figure 6:
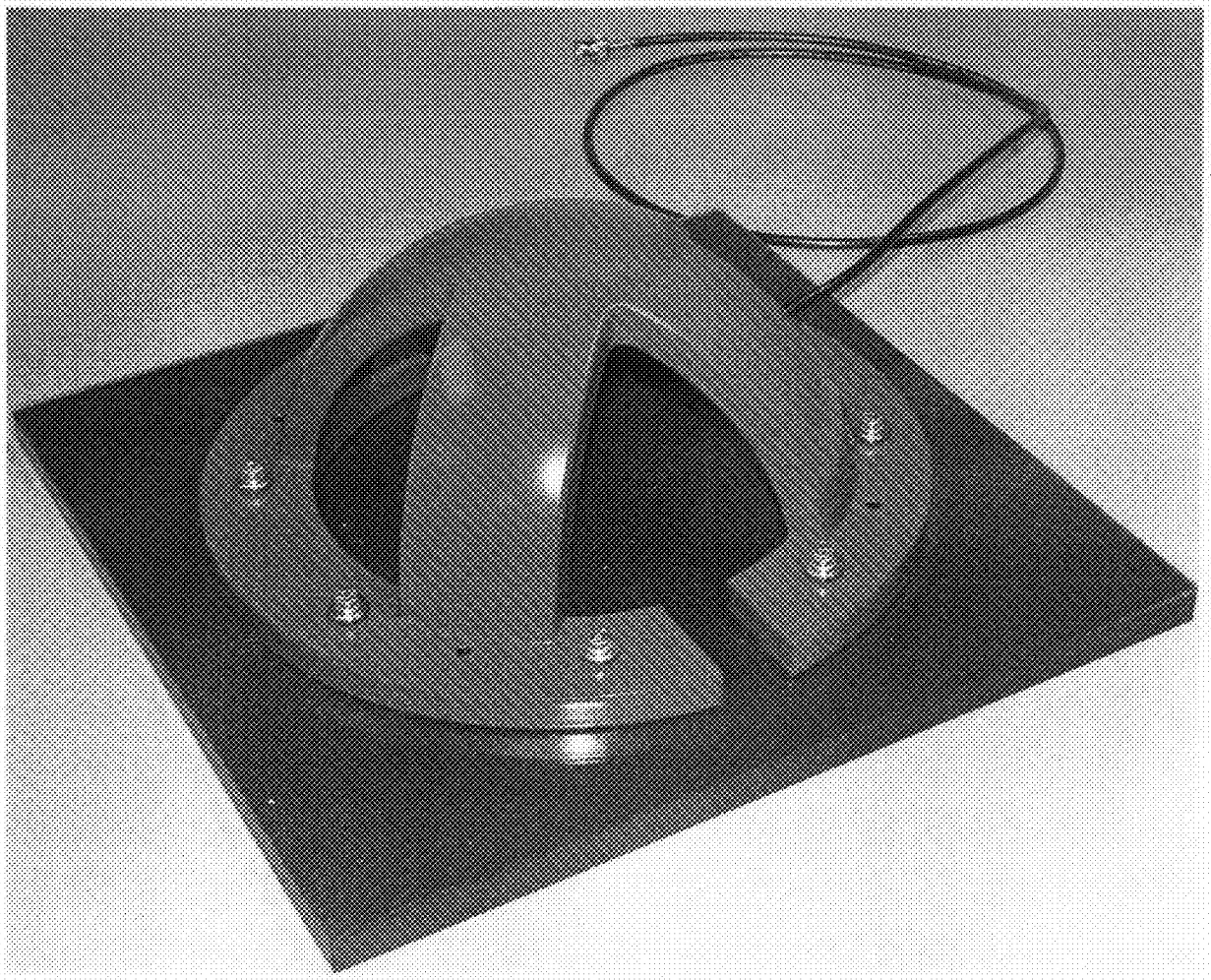
FIG. 6 shows a photographic image of an antenna constructed in accordance with the embodiment of FIG. 2A.
Figure 7:
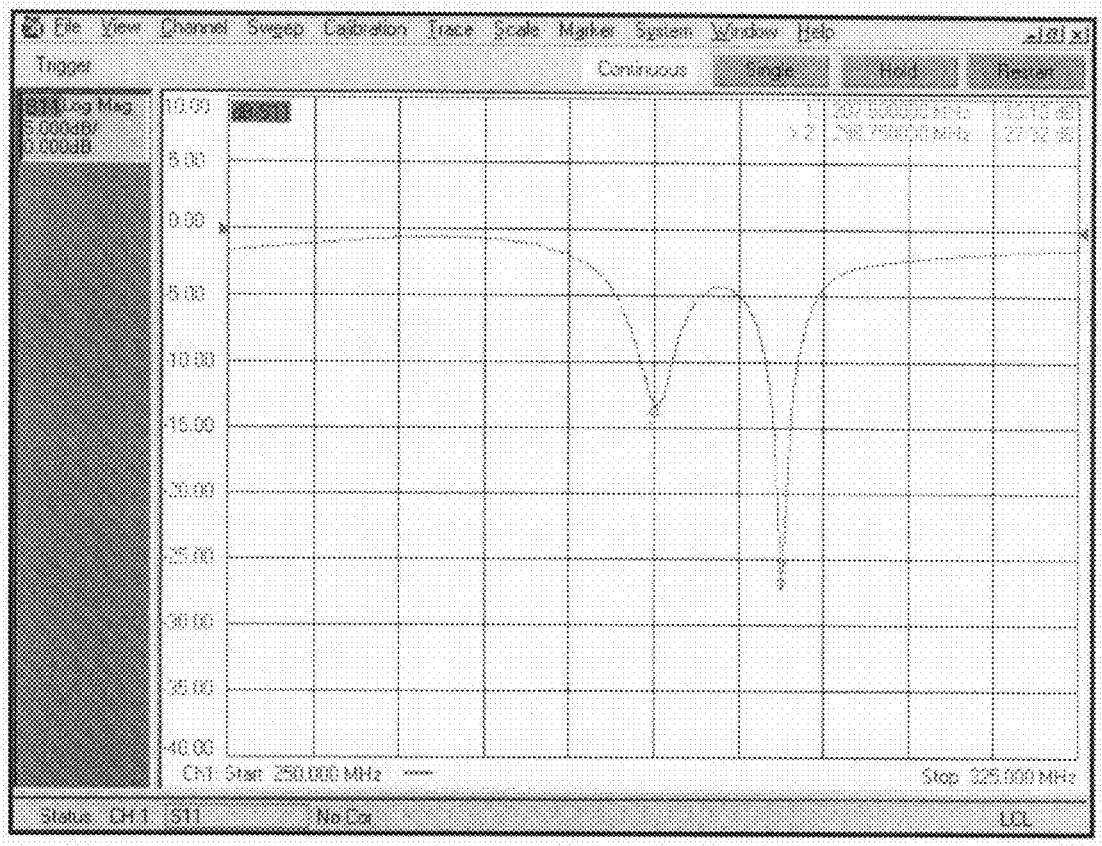
FIG. 7 shows the return loss of the antenna measured on a network analyzer.
Figure 8:
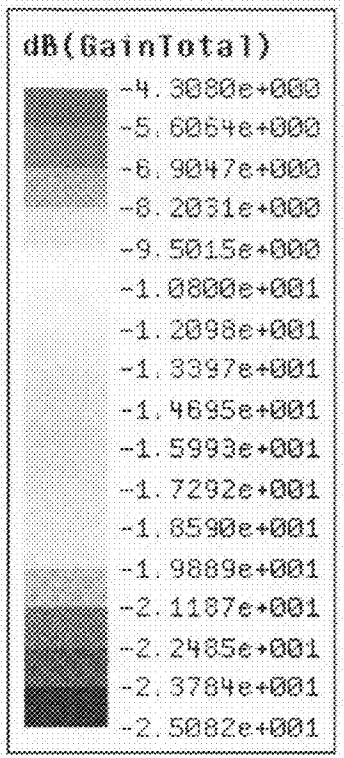
FIG. 8 shows a simulated radiation pattern of the antenna.
Figure 8:
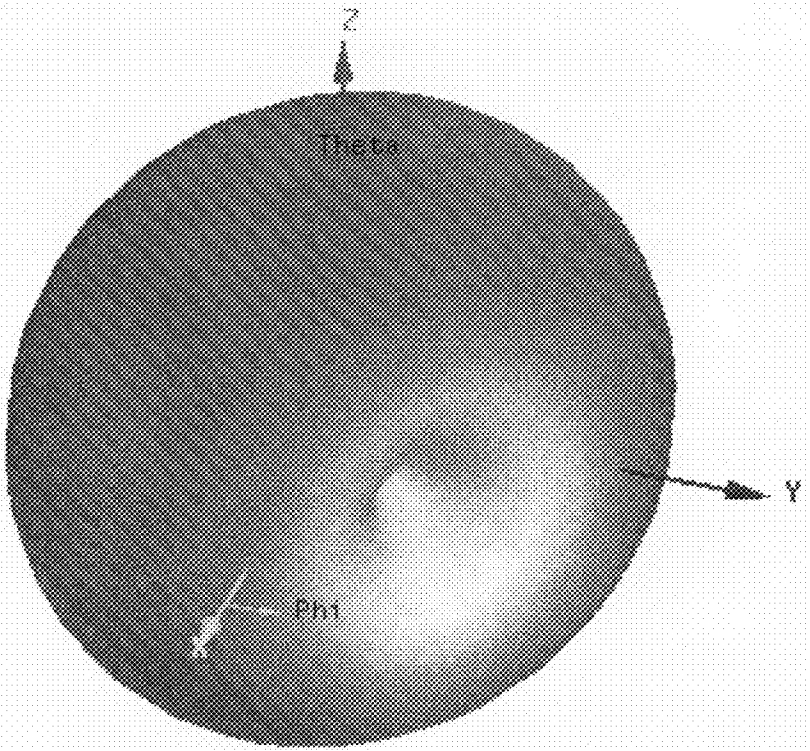

FIG. 6 shows a prototype of a finished antenna that was machined out of aluminum, anodized, and coated with nylon. A 2.4 mm thick sheet of polycarbonate plastic was used as the dielectric insulator. To measure the performance of the prototype antenna, the antenna was attached to the ground plane as described above and then connected to a network analyzer and the return loss was measured. As is shown in FIG. 7, the present antenna exhibits a modest return loss of −13.1 dB at 287.5 MHz and a much better return loss of −27.3 dB at 299 MHz. In order to estimate the radiation behavior of the prototype antenna, a simulation was run using simulation software available from Ansoft Corporation (Pittsburg, Pa.). FIG. 8 provides a graphical representation of the antenna simulated radiation pattern showing it is indeed essentially omnidirectional in azimuth and in elevation from the horizon to zenith.

Alternative Embodiments

The antenna can be operated at other frequencies by adjusting the parameters previously described. Scaling the physical size of the antenna will also result in a corresponding change in operational frequency, e.g. reducing the size of the antenna will allow it to operate at higher frequencies.

Figure 9:
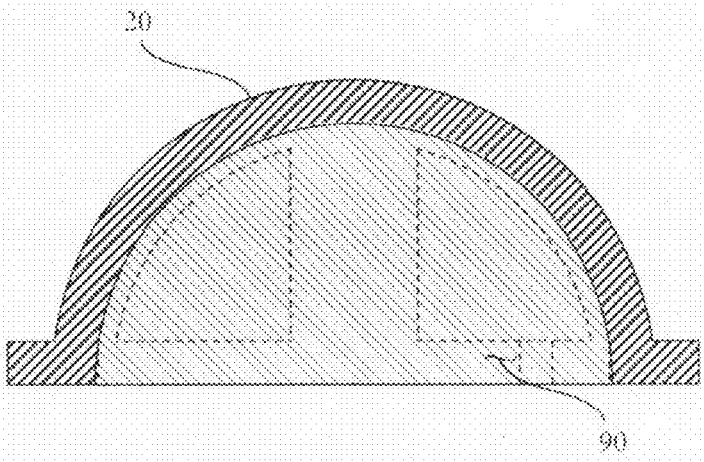
FIG. 9 shows a cross-sectional view of the embodiment shown in FIG. 2A showing the interior of the antenna filled with a dielectric material other than air.

Another embodiment comprises filling the interior space beneath the crossed elements of the antenna and the ground plane with a dielectric medium 90, other than air, such as is shown in FIG. 9. Moldable materials such rubbers, foams, and curable resins are useful. In particular, natural and synthetic dielectric material such as mica, wood, glass, gypsum, chalk, ceramic, various oxides and carbonates, rubbers, phenolics, urea and maleimide resins, polymers, polymer resins, epoxy resins, acetal resins, acrylics, polyvinyl chlorides, polyurethanes, polyisocyanurates, polytetrafluoroethylenes, thermoplastic plastics, thermosetting plastics, and combinations thereof, are particularly useful. This approach has the effect of making the antenna electrically "smaller" and therefore able to operate at lower frequencies by changing the dielectric value of the interior volume of space beneath the crossed elements of the antenna and the ground plane. It is to be understood, of course, that while FIG. 9 illustrates an embodiment having a particular radiation structure any of the other structure described above are equally useful.

Figure 3A:
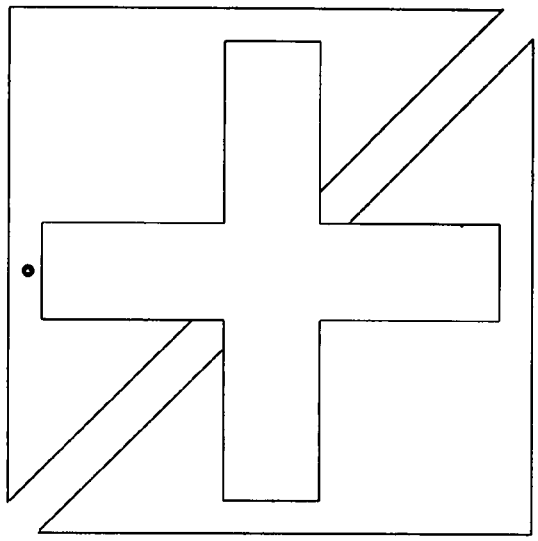
FIGS. 3A-3C show various embodiments of conductive plates that may be used to practice the invention.
Figure 3B:
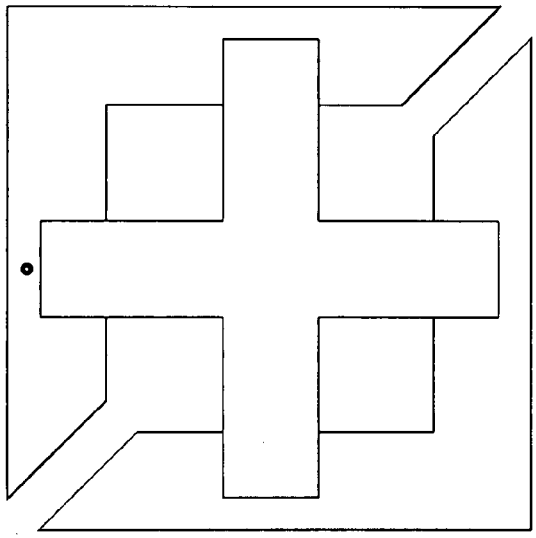
Figure 3C:
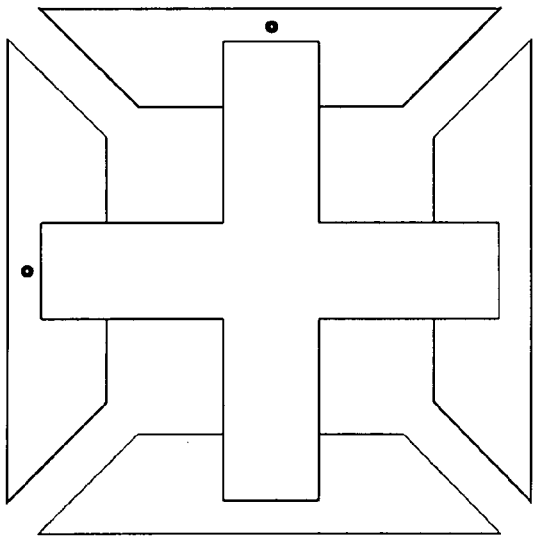
Figure 3D:
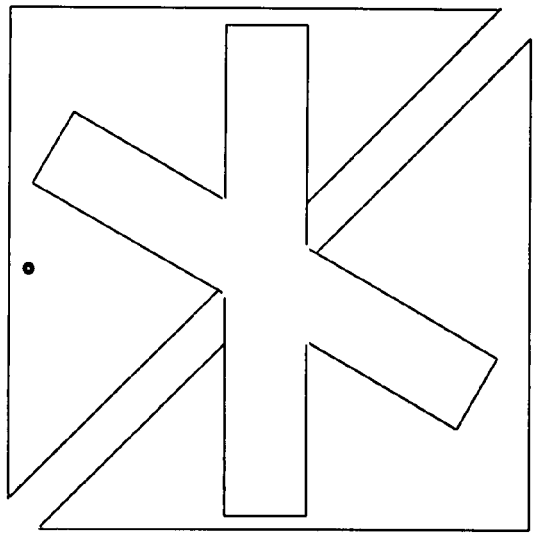
FIGS. 3D-3F show various radiation structures comprising two or more dipole elements illustratively joined with different conductive plate configurations.
Figure 3E:
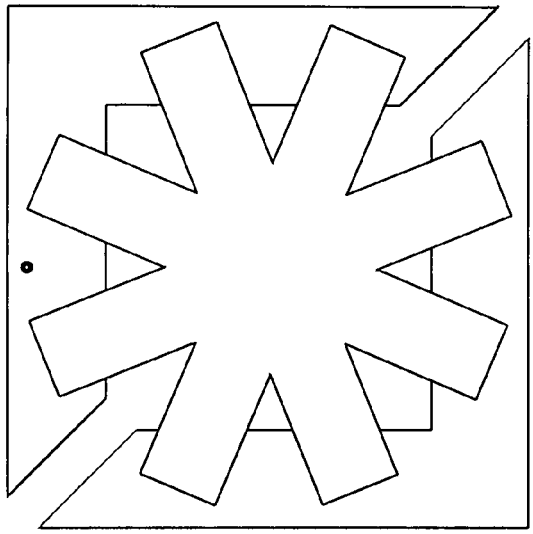
Figure 3F:
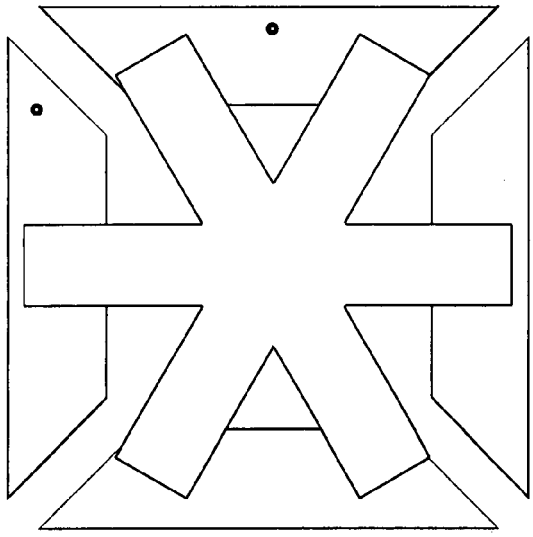
Figure 3G:
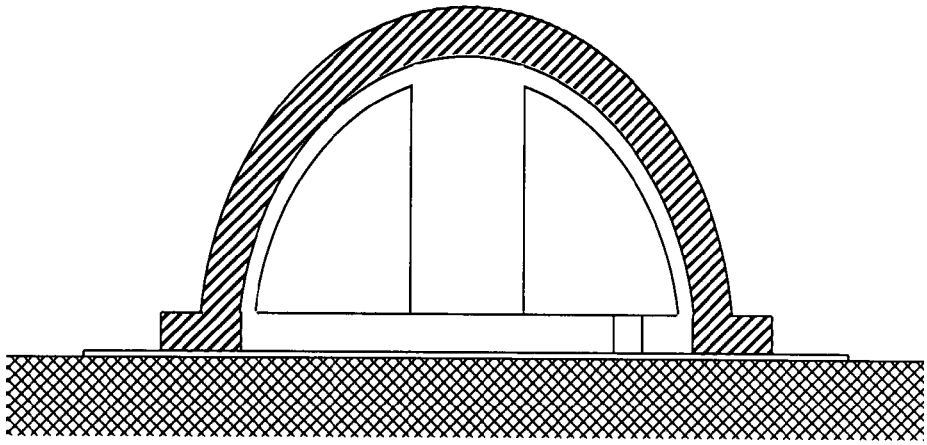
FIGS. 3G-3I show cross-sectional views of a variety of different radiation structure geometries which may be used to practice the invention.
Figure 3H:
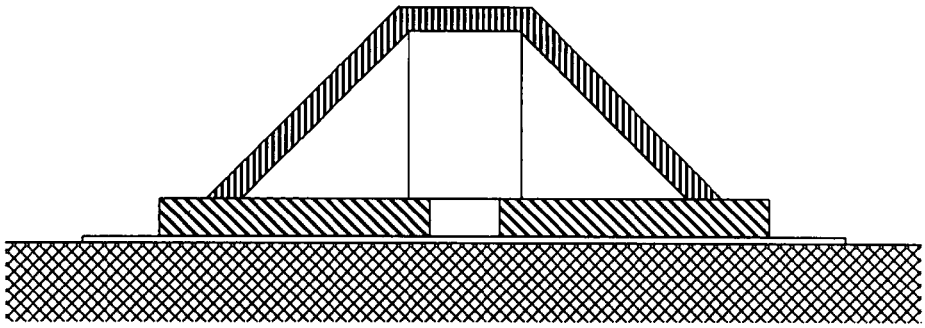
Figure 3I:
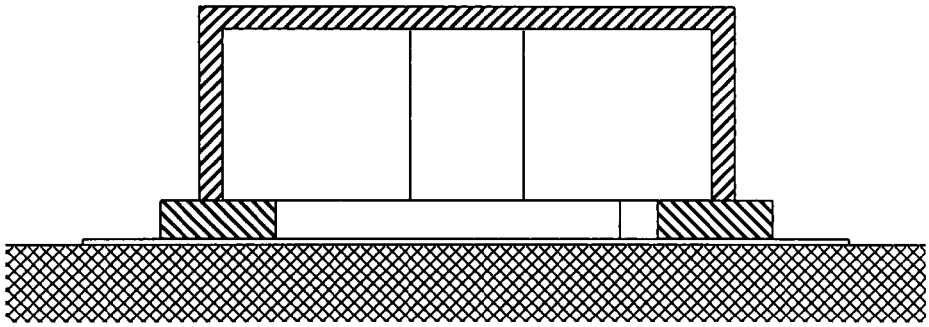
Figure 10A:
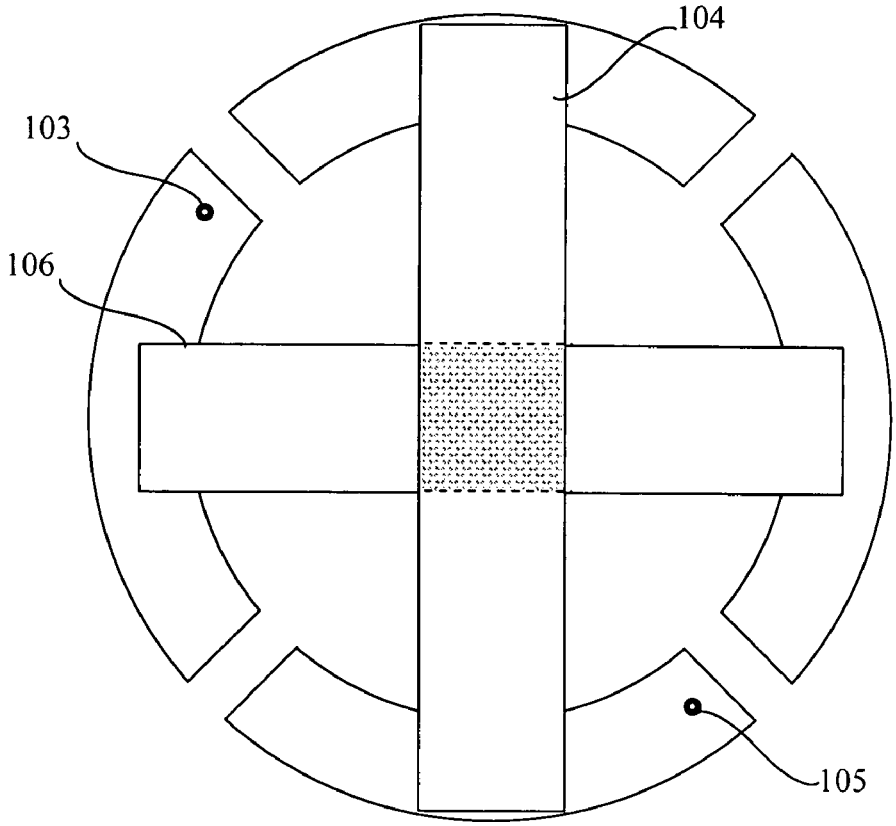
FIG. 10A shows a top view of an antenna according to the present embodiment modified to provide circularly polarized transmission.
Figure 10B:
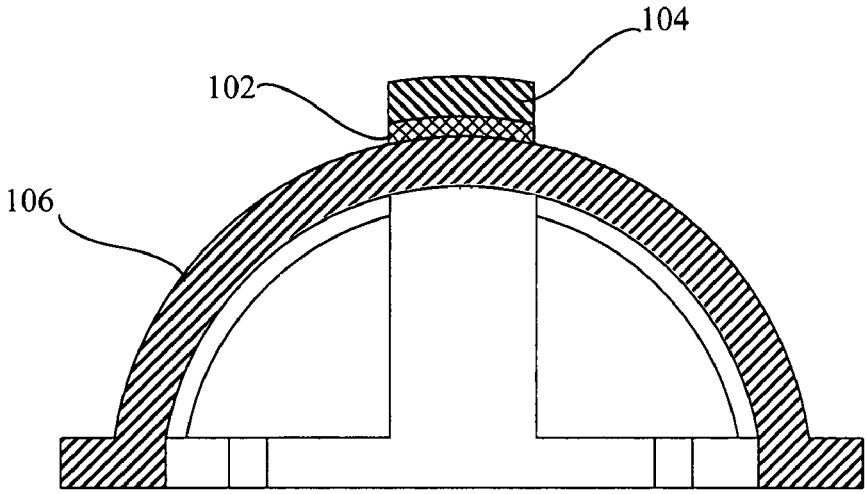
FIG. 10B shows a cross-sectional side view of an antenna according to the present embodiment modified to provide circularly polarized transmission.

Another embodiment comprises an antenna structure that provides circularly polarized radiation. As shown in FIGS. 10A and 10B, a simple modification to the preferred embodiment can be made which amounts to replacing the cross-like structure of FIGS. 2A and 2B with two separate semicircular arch elements 104 and 106, wherein one arch extends over the other, and wherein a dielectric pad 102 separating the two where the two members cross each other as is shown in FIG. 10A. This embodiment also includes replacing the two semicircular, annular ring segments with four equivalent smaller ring segments by bisecting each of the former annular ring segments such that each of the two ends of each arch rests on two separate segments. An equivalent structure is shown in FIGS. 3C and 3F which uses quarter segments of a square conductive plate. First and second "feed" lines (not shown) are connected to electrical feed points 103 and 105 attached to two adjacent ring segments such that each of the separate arch elements can be separately is driven by an electrical signal. Again, it is understood that the radiation structures described in this embodiment may be replaced with any of the structure described above and illustrated in FIGS. 3D through 3I.

Figure 11A:
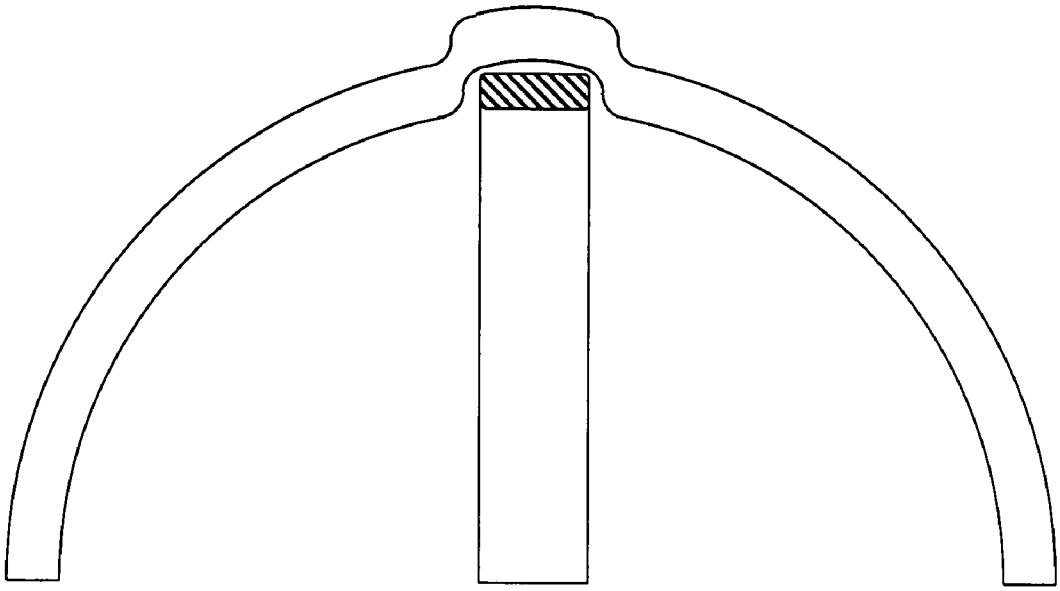
FIGS. 11A and 11B show cross-sectional side views of two different embodiments of an antenna modified to provide circularly polarized transmission, wherein the crossed elements have the same diameter and where a portion of the center one element is deformed to allow access to the crossing arm.
Figure 11B:
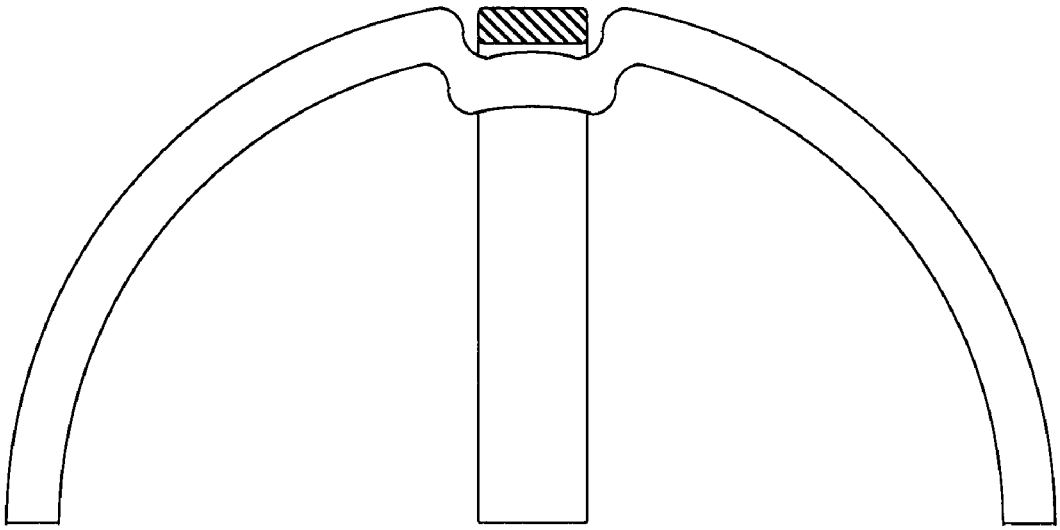

Furthermore, this alternative embodiment may be deployed in two different configurations. The first comprises a structure wherein the two semicircular arches have different diameters. The second comprises the structure shown in FIGS. 11A and 11B wherein both of the two arches have the same diameter but wherein one of them includes either an intermediate rise or dip in its diameter along a short distance at the center of its length depending on whether the one arch passes over or under the second arch. Both of these alternative embodiments allow each of the two arch elements to be driven separately allowing an operator to control the signal phase fed into each element and, therefore, the polarity of each element. Moreover, the structures illustrated in FIGS. 3G through 3I can be similarly modified and applied to this embodiment.

Finally, to the extent necessary to understand or complete the disclosure of the present invention, all publications, patents, and patent applications mentioned herein are expressly incorporated by reference therein to the same extent as though each were individually so incorporated.

Having thus described exemplary embodiments of the present invention, it should be noted by those skilled in the art that the disclosures herein are exemplary only and that various other alternatives, adaptations, and modifications may be made within the scope of the present invention. Accordingly, the present invention is not limited to the specific embodiments as illustrated herein, but is only limited by the following claims.

What is claimed is:

1. An antenna structure, comprising:

a dielectric layer disposed over a conductive ground layer;

first and second conductive plates disposed on the dielectric layer, wherein distal ends of each plate are arranged about parallel to one another and form one or more air gaps;

a conductive, free-standing radiation structure in electrical communication with the first and second conductive plates, wherein the radiation structure comprises one or more pairs of oppositely directed radiator elements, wherein each of the pairs of elements extend from a common center along a line from the common center to one of the first or second conductive plates, and wherein each pair of radiator elements is spaced apart from each adjacent pair of radiator elements; and means for attaching an electrical feed line to one of the first or second conductive plates, said electrical feed line for driving a radio frequency signal through the radiation structure.

2. The antenna structure of claim 1, wherein each of the first and second conductive plates comprise a portion of a ring having a common parameter.

3. The antenna structure of claim 1, wherein the conductive, free-standing radiation structure comprises a conductive, cross-shaped structure.

4. The antenna structure of claim 3, wherein the cross-shaped structure further comprises four arm members radiating from a common center and disposed at intervals of about 90°, wherein each arm member extends along a line of the center and terminates on one of the first or second conductive plates.

5. The antenna structure of claim 1, wherein the one or more air gaps have the same width.

6. The antenna structure of claim 1, wherein the dielectric capacitance of each of the one or more air gaps is separately adjustable.

7. The antenna structure of claim 6, wherein the dielectric capacitance of each of the one or more air gaps is adjusted by changing the widths of one or both of the first and second air gaps.

8. The antenna structure of claim 6, wherein the dielectric capacitance of each of the one or more air gaps is adjusted by introducing a dielectric medium other than air into the one or more air gaps.

9. The antenna structure of claim 1, wherein the capacitance of the dielectric layer is adjustable.

10. The antenna structure of claim 1, wherein the radiation structure is disposed above the dielectric layer and generally encloses a volume of space comprising a 3-dimensional shape selected from the list consisting of a hemisphere, an oblate hemisphere, a hemi-ellipsoid, a cube, an orthorhombic prism, and a polyhedral pyramid.

11. The antenna structure of claim 1, further comprising a means for adjusting the dielectric value of the volume of space disposed between the radiation structure and the dielectric layer.

12. The antenna structure of claim 11, wherein said means for adjusting comprises filling the volume of space with a dielectric material other than air.

13. The antenna structure of claim 12, wherein the dielectric material is either a natural or a synthetic material.

14. The antenna structure of claim 13, wherein the natural and synthetic dielectric material is selected from the group of materials consisting of mica, wood, glass, gypsum, chalk, ceramic, oxides and carbonates, rubbers, phenolics, urea and maleimide resins, polymers, polymer resins, epoxy resins, acetal resins, acrylics, polyvinyl chlorides, polyurethanes, polyisocyanurates, polytetrafluoroethylenes, thermoplastic plastics, thermosetting plastics, and combinations thereof.

15. An antenna structure, comprising:

a dielectric layer disposed over a conductive ground layer;

first, second, third and fourth conductive plates disposed on the dielectric layer, wherein the first and third conductive plates and said second and fourth conductive plates are disposed opposite each other to form a flat structure having a center point, and wherein distal ends of each plate are arranged about parallel to one another and form first, second, third and fourth air gaps;

first and second dipole elements each comprising pairs of oppositely directed radiator elements, wherein the first dipole is in electrical communication with and extends over a first length between the first and third conductive plates along a line running through a first point above the center point, wherein the second dipole is in electrical communication with and extends over a second length between the second and fourth conductive plates along a line running through a second point above the center point of the geometric structure, wherein the first and second dipole elements do not contact one another; and means for attaching a first and second electrical feed line to either of the first and second or to either of the third and fourth conductive plates, said electrical feed line for driving a radio frequency signal through the radiation structure.

16. The antenna structure of claim 15, wherein each of the first, second, third and fourth conductive plates comprise a portion of a ring having a common parameter.

17. The antenna structure of claim 15, wherein the first length of the first dipole element is different than the second length of the second dipole element.

18. The antenna structure of claim 15, wherein the first element includes a notched or raised region at its center along a portion of its length to provide access for the second dipole element to pass above or below the dipole element.

19. The antenna structure of claim 15, wherein the dielectric capacitances of the first, second, third and fourth air gaps are separately adjustable.

20. The antenna structure of claim 19, wherein the dielectric capacitances of the first, second, third and fourth air gaps are adjusted by changing the widths of the air gaps.

21. The antenna structure of claim 19, wherein the dielectric capacitances of the first, second, third and fourth air gaps are adjusted by introducing a dielectric medium other than air into one or more of the air gaps.

22. The antenna structure of claim 15, further comprising a means for adjusting the dielectric value of the volume of space disposed between the first and second dipole elements and the dielectric layer.

23. The antenna structure of claim 22, wherein said means for adjusting comprises filling the volume of space with a dielectric material other than air.

24. The antenna structure of claim 23, wherein the dielectric material is either a natural or a synthetic material.

25. The antenna structure of claim 23, wherein the natural and synthetic dielectric material is selected from the group of materials consisting of mica, wood, glass, gypsum, chalk, ceramic, oxides and carbonates, rubbers, phenolics, urea and maleimide resins, polymers, polymer resins, epoxy resins, acetal resins, acrylics, polyvinyl chlorides, polyurethanes, polyisocyanurates, polytetrafluoroethylenes, thermoplastic plastics, thermosetting plastics, and combinations thereof.

* * * * *